US008641451B2

(12) United States Patent
Zheng et al.

(10) Patent No.: US 8,641,451 B2
(45) Date of Patent: Feb. 4, 2014

(54) HDMI CONNECTOR

(75) Inventors: Zhifeng Zheng, Shenzhen (CN); Gang Xie, Shenzhen (CN)

(73) Assignee: Amphenol East Asia Electronic Technology (Shenzhen) Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 13/187,543

(22) Filed: Jul. 21, 2011

(65) Prior Publication Data

US 2012/0003876 A1 Jan. 5, 2012

Related U.S. Application Data

(63) Continuation-in-part of application No. 12/826,706, filed on Jun. 30, 2010, now abandoned.

(51) Int. Cl.
*H01R 13/648* (2006.01)

(52) U.S. Cl.
USPC ..... 439/607.54

(58) Field of Classification Search
USPC ..... 439/607.54, 607.37, 607.4, 607.35
See application file for complete search history.

(56) References Cited

U.S. PATENT DOCUMENTS 7,871,297 B2 * 1/2011 Li ..... 439/607.54

* cited by examiner

*Primary Examiner* — Gary Paumen
(74) *Attorney, Agent, or Firm* — Leong C. Lei

(57) ABSTRACT

A HDMI connector includes a metallic housing having two plates respectively extending downward from two opposite sides thereof, an insulated body mounted in the metallic housing, and a plurality of electrically conducting pins installed with the insulated body. The metallic housing has two legs each located in front of a respective one of the plates, each leg being integrally formed by cutting a portion of the metallic housing and bending the portion downward. Each leg has a base portion and a solder portion extending from the base portion to be electrically connected to a printed circuit board, wherein the base portion is formed substantially at a right angle with respect to the solder portion and has a dimension greater than the solder portion. The HDMI connector can save material in manufacturing and increase space availability.

3 Claims, 4 Drawing Sheets

HDMI CONNECTOR

CROSS-REFERENCE TO RELATED APPLICATION

This is a continuation-in-part of the co-pending patent application Ser. No. 12/826,706,filed Jun. 30, 2010 owned by the same applicant.

TECHNICAL FIELD OF THE INVENTION

The present invention relates to a connector and, more particularly, to an HDMI connector.

DESCRIPTION OF THE PRIOR ART

HDMI (high definition multimedia interface) connector is an interface for transmitting digital signal of video and audio, including compressed and uncompressed digital data. The HDMI technology can be applied in various devices, such as set-top boxes, DVD players, personal computers, video game consoles, integrated amplifiers, digital audios, digital televisions, and the likes.

The HDMI technology allows a display to have a resolution of more than 1080p. The HDMI technology also supports advanced formats for digital audio devices as well, which allows transmitting 8 channels of uncompressed audio with sample rates from 32 kHz to 192 kHz by one HDMI cable. Furthermore, since the HDMI technology allows a device to have a maximum throughput of more than 4 Gbps while the bandwidth required for a device having a 1080p of resolution and 8 channels of audio of audio signal is far less than the throughput, the HDMI technology will satisfy the bandwidth requirement for an upgrade of video and audio technology in the future. Also, because of the large throughput, the HDMI technology allows several audio or video devices share one cable. In addition, the HDMI technology supports DDC2B (display data channel, version 2) or E-DDC (enhanced display data channel), and EDID (extended display identification data) or E-EDID (enhanced EDID) to provide an experience of "plug and play" for devices, whereby a host display and a graphic adapter can communicate each other to enable the display to communicate its supported display modes to the adapter and to enable the host to adjust monitor parameters, such as brightness and contrast.

Among the existing HDMI connectors, there is a type of connector including a metallic housing, an insulated body mounted in the metallic housing, and a plurality of electrically conducting pins, wherein the metallic housing has a connection portion at the front thereof and a solder portion extends downwardly, the connection portion and the solder portion being used for a mounting. This type of connector consumes more metallic material, thereby causing a high cost of manufacturing. Thus, there is a need for further improvement.

SUMMARY OF THE INVENTION

The primary object of the present invention is to provide a HDMI connector that can save material in manufacturing and increase the space availability.

To achieve the above object, the present invention provides a HDMI connector that includes a metallic housing having two plates respectively extending downward from two opposite sides thereof, an insulated body mounted in the metallic housing, and a plurality of electrically conducting pins installed with the insulated body; wherein the metallic housing has two legs each located in front of a respective one of the plates, each leg being integrally formed by cutting a portion of the metallic housing and bending the portion downward, each leg integrally formed from a portion of the metallic housing having a base portion and a solder portion extending from the base portion to be electrically connected to a printed circuit board. As compared to the existing connectors, the present invention can save the metallic material, reduce the manufacturing cost, and have more space availability.

A second object of the present invention is to provide a HDMI connector that is not prone to be broken or damaged.

To achieve the above object, the legs integrally formed from a portion of the metallic housing has a base portion and a solder portion extending from the base portion, the base portion being formed substantially at a right angle with respect to the solder portion and having a dimension greater than the solder portion, whereby the strength of the legs can be increased so as to protect the legs from being broken or damaged.

A third object of the present invention is to provide a HDMI connector that can prevent the electrically conducting pins from detaching from the insulated body.

To achieve the above object, the insulated body is provided with a portion defining a plurality of recesses at a front end thereof, one end of each electrically conducting pin can be inserted into one of the recesses of the portion at the front end of the insulated body, whereby each electrically conducting pin can be prevented from detaching from the insulated body to achieve the purpose of protecting the electrically conducting pins.

Other objects, advantages, and novel features of the present invention will become more apparent from the following detailed description when taken in conjunction with the accompanying drawings.

DETAILED DESCRIPTION OF THE PREFERRED EMBODIMENTS

To allow the structure and advantages of the present invention to be understood more easily, a description is detailed with reference to the accompanying drawings in the following.

Figure 1:
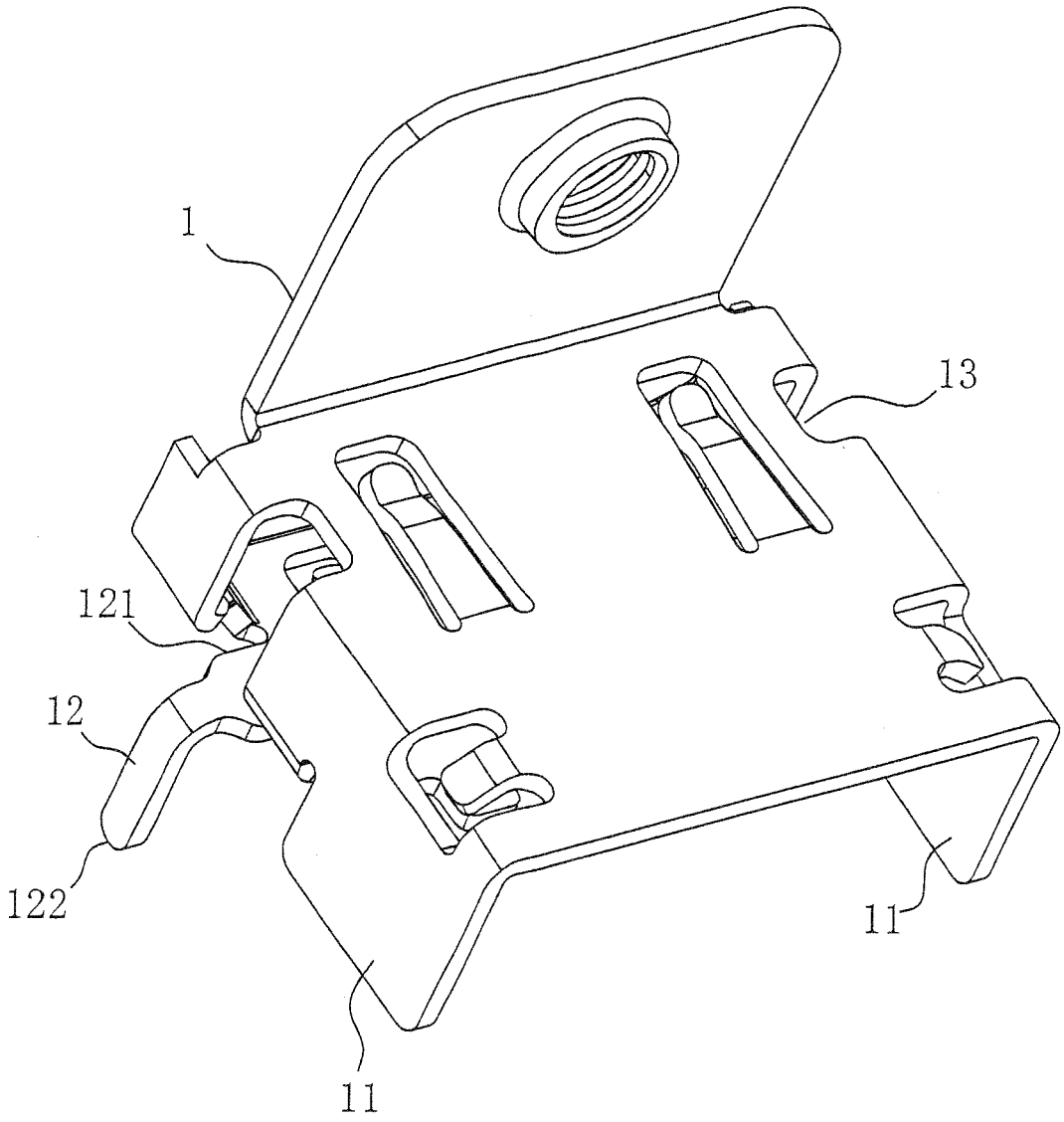
FIG. 1 is a 3-dimensional view of an embodiment of the present invention, which shows a HDMI connector.
Figure 2:
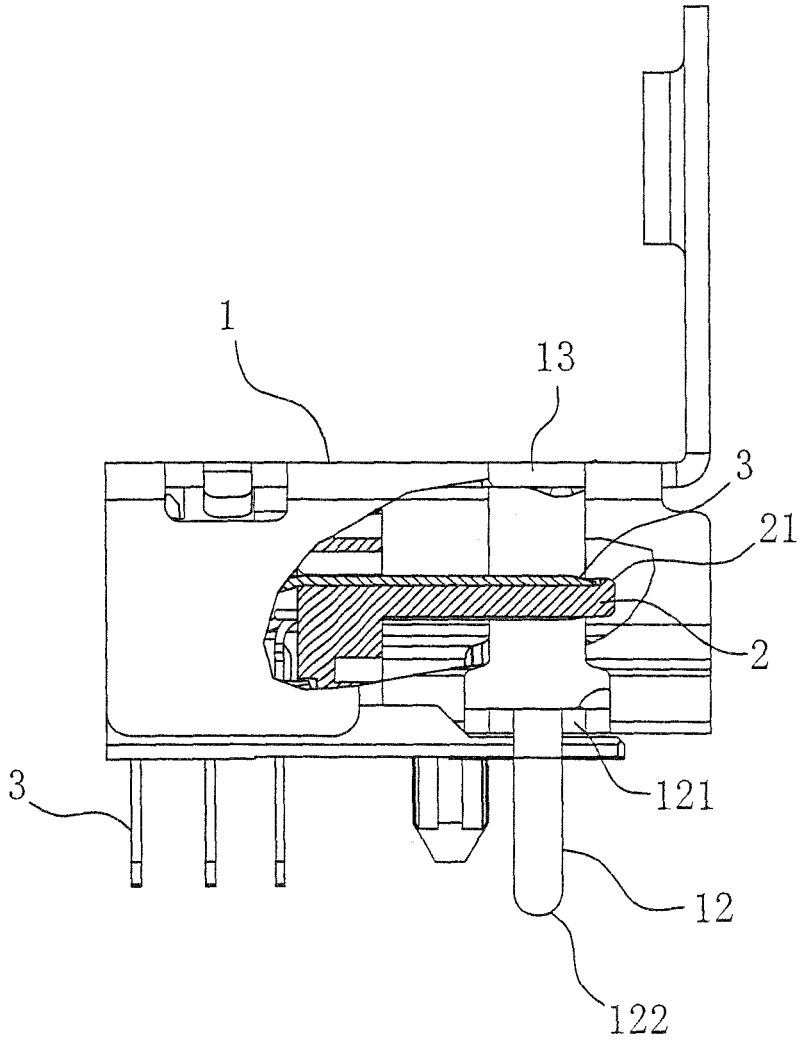
FIG. 2 is a partially sectional view of the embodiment of the present invention, which is viewed from right side of the HDMI connector.
Figure 3:
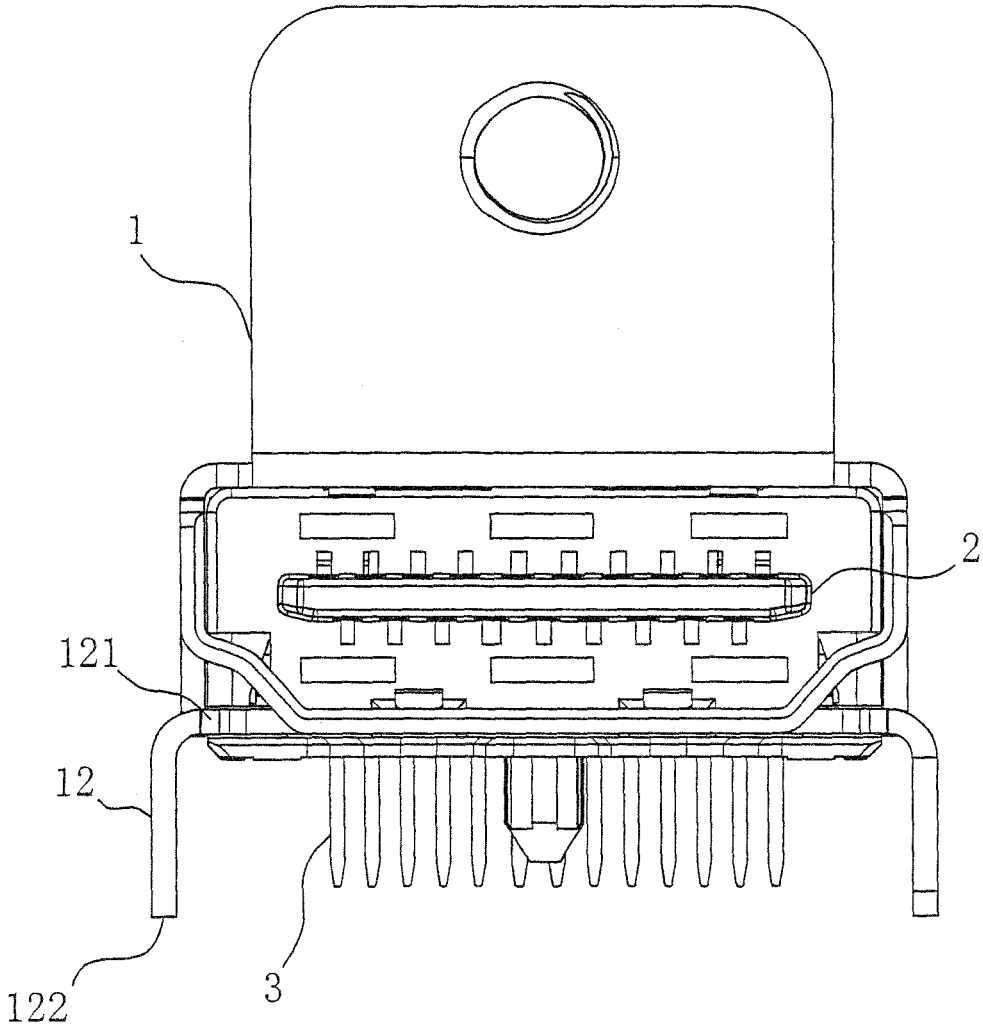
FIG. 3 is a front view of the embodiment of the present invention.
Figure 4:
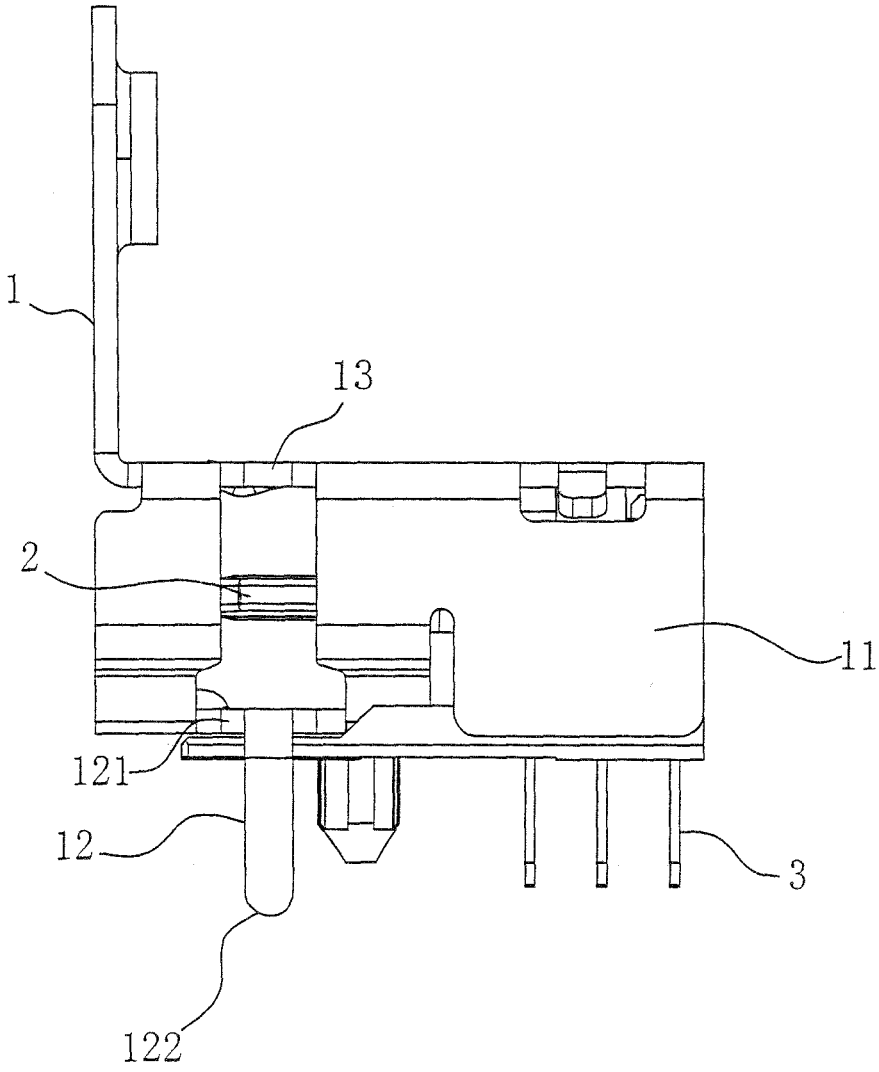
FIG. 4 is a left side view of the embodiment of the present invention.

Referring to FIGS. 1-4, an embodiment of a HDMI connector of the present invention generally comprises a metallic housing 1, an insulated body 2, and a plurality of electrically conducting pins 3. The metallic housing 1 has two plates 11 respectively extending downward from two opposite sides thereof, and two legs 12 each located in front of a respective one of the plates 11. Each leg 12 is integrally formed by cutting a portion of the metallic housing 1 and bending the portion downward. Each leg 12 has a base portion 121 and a solder portion 122 extending from the base portion 121 to be electrically connected to a printed circuit board (not shown), wherein the base portion 121 is formed substantially at a right angle with respect to the solder portion 122, and has a dimension substantially greater than the solder portion 122. The solder portion 122 of each leg 12 can be a member of any shape, such as a straight pin. The electrically conducting pins 3 are installed with the insulated body 2, wherein each electrically conducting pin 3 can have any shape according to the mounting of the connector. In the embodiment, each electrically conducting pin 3 has a 90-degree bend. However, the electrically conducting pins 3 are not limited to the shape. The electrically conducting pins 3 are attached to the outer surface of the insulated body 2 at an interval therebetween. Each electrically conducting pin 3 has one end to be inserted into a recess defined by a portion 21 at a front end of the insulated body 2 and another end extending out of the metallic housing 1 to be electrically connected to a printed circuit board (not shown).

In manufacturing, the leg 12 is cut from a portion of the metallic housing 1, thereby leaving an opening 13 on the metallic housing 1. Since the leg 12 is constructed of the material from the metallic housing 1, additional material will not be required for the leg 12, and thus the manufacturing cost can be reduced. Furthermore, the base portion 121 of the leg 12 has a dimension greater than the solder portion 122 of the leg 12 and this feature can enhance the strength of the leg 12 so that the leg 12 will not be prone to be broken or damaged. Still furthermore, the insulated body 2 is provided with a portion 21 defining a plurality of recesses at the front end thereof, so that one end of each electrically conducting pin 3 can be inserted into one of the recesses of the portion 21, so as to prevent the electrically conducting pins 3 from detaching from the insulated body 2 so as to protect the electrically conducting pins 3.

The present invention has following advantages: the material required for manufacturing the metallic housing 1 can be reduced and thus the manufacturing cost can be lowered, as each leg 12 is integrally formed with the metallic housing 1 by cutting a portion of the metallic housing 1 and bending the portion; the present invention will have more space availability than existing connectors; the leg 12 of the present invention is not prone to be broken or damaged, as the leg 12 is formed with a base portion 121 having a dimension greater than the solder portion 122; the electrically conducting pins 3 can be prevented from detaching from the insulated body 2, as the insulated body 2 is provided with a portion 21 defining a plurality of recesses, into which one end of each electrically conducting pin 3 can be inserted.

In view of the foregoing, it is believed that the present invention is a useful creation with novel features. An early and favorable action is respectfully solicited.

Although the present invention has been described with a certain degree of particularity, it is understood that the present disclosure is made by way of example only and the combination and arrangement of parts may be resorted to without departing from the spirit and scope of the invention hereinafter claimed.

We claim:

1. An improved HDMI connector of the type that includes a metallic housing having two plates respectively extending downward from two opposite sides thereof, an insulated body mounted in said metallic housing, and a plurality of electrically conducting pins installed with said insulated body; characterized in that:

said metallic housing has two legs each located in front of a respective one of said plates, each said leg being integrally formed by cutting a portion of said metallic housing and bending the portion downward so that each said leg is integrally connected to an edge of a bottom plate of said metallic housing, each said leg having a base portion and a solder portion extending from said base portion to be electrically connected to a printed circuit board, wherein said base portion of each said leg extends from said edge of said bottom and is substantially coplanar with said bottom and said solder portion is formed through said bending to be substantially at a right angle with respect to said base portion of each said leg, said base portion having a substantially constant dimension greater than a substantially constant dimension of said solder portion of each said leg, whereby each said leg is strengthened at the corresponding base portion thereof to further protect each said leg from being broken off said metallic housing.

2. An improved HDMI connector as claimed in claim 1, wherein said solder portion of each said leg is formed into a straight pin.

3. An improved HDMI connector as claimed in claim 1, wherein said insulated body is provided with a portion defining a plurality of recesses at a front end thereof, one end of each said electrically conducting pin being inserted into one of said recesses of said portion at the front end of said insulated body.

* * * * *